US007269266B2

(12) United States Patent
Anjanappa et al.

(10) Patent No.: US 7,269,266 B2
(45) Date of Patent: Sep. 11, 2007

(54) METHOD AND APPARATUS FOR TOOTH BONE CONDUCTION MICROPHONE

(75) Inventors: Muniswamappa Anjanappa, Ellicott City, MD (US); Xia Chen, Catonsville, MD (US); Russell E. Bogacki, Richmond, VA (US); Abdo J. Babik, Bumpass, VA (US)

(73) Assignee: Mayur Technologies, Rockville, MD (US)

( * ) Notice: Subject to any disclaimer, the term of this patent is extended or adjusted under 35 U.S.C. 154(b) by 139 days.

(21) Appl. No.: 10/745,226

(22) Filed: Dec. 23, 2003

(65) Prior Publication Data

US 2004/0202344 A1 Oct. 14, 2004

Related U.S. Application Data

(60) Provisional application No. 60/461,601, filed on Apr. 8, 2003, provisional application No. 60/517,746, filed on Nov. 6, 2003.

(51) Int. Cl.
*H04R 25/00* (2006.01)

(52) U.S. Cl. ..... 381/151; 381/326

(58) Field of Classification Search ..... 381/151, 381/150, 326; 181/128; 600/25; 607/56, 607/57; 367/131, 132

See application file for complete search history.

(56) References Cited

U.S. PATENT DOCUMENTS

| | | | | |
|---|---|---|---|---|
| 4,498,461 A | | 2/1985 | Hakansson | 128/1 R |
| 4,562,432 A | * | 12/1985 | Sremac | 345/184 |
| 5,033,999 A | | 7/1991 | Mersky | 600/25 |
| 5,163,093 A | | 11/1992 | Frielingsdorf et al. | 381/151 |
| 5,327,506 A | | 7/1994 | Stites, III et al. | 381/169 |
| 5,447,489 A | * | 9/1995 | Issalene et al. | 600/25 |
| 5,455,842 A | | 10/1995 | Mersky et al. | 375/175 |
| 5,460,593 A | | 10/1995 | Mersky et al. | 600/25 |
| 5,579,284 A | | 11/1996 | May | 367/132 |
| 5,706,251 A | | 1/1998 | May | 367/132 |
| 6,115,477 A | * | 9/2000 | Filo et al. | 381/151 |
| 6,411,828 B1 | * | 6/2002 | Lands et al. | 455/569.1 |
| 6,664,713 B2 | * | 12/2003 | Boesen | 310/328 |
| 6,823,171 B1 | * | 11/2004 | Kaario | 455/41.1 |

OTHER PUBLICATIONS

Townend, "Audiodontics-A Case Report" J. Dentistry, 1974.
Dahlin & Allen, "Bone Conduction Thresholds of Human Teeth", J. Accustic Society AM. 1973.
Stenfelt & Hakansson, "Sensitivity to Bone-Conducted Sound", Scandinavian Audiology, 1999.
Veneklasen & Christoff, Speech Detection in Noise Abstract Only, J. Acc Soc. of AM. 1960.

* cited by examiner

*Primary Examiner*—Curtis Kuntz
*Assistant Examiner*—Tuan D. Nguyen
(74) *Attorney, Agent, or Firm*—Clifford Kraft

(57) ABSTRACT

A tooth microphone apparatus worn in a human mouth that includes a sound transducer element in contact with at least one tooth in mouth, the transducer producing an electrical signal in response to speech and a means for transmitting said electrical signal from the sound transducer to an external apparatus. The sound transducer can be a MEMS accelerometer, and the MEMS accelerometer can be coupled to a signal conditioning circuit for signal conditioning. The signal conditioning circuit can be further coupled to a transmitter. The transmitter can be an RF transmitter of any type, an optical transmitter, or any other type of transmitter. In particular, it can be a bluetooth device or a device that transmits into a Wi-Fi network or any other means of communication. The transmitter is optional.

20 Claims, 6 Drawing Sheets

METHOD AND APPARATUS FOR TOOTH BONE CONDUCTION MICROPHONE

This application is related to an claims priority from provisional patent application 60/461,601 filed Apr. 8, 2003 and to provisional patent application 60/517,746 filed Nov. 6, 2003. Applications 60/461,601 and 60/517,746 are hereby incorporated by reference.

This invention was made with Government support under DAAH01-03-C-R210 awarded by the U.S. Army Aviation and Missile Command. The U.S. Government may have rights in this invention.

BACKGROUND

1. Field of the Invention

The present invention relates generally to the field of microphones and more particularly to a tooth bone conduction microphone method and apparatus.

2. Description of the Prior Art

Conventional (air-conduction type) microphones are routinely used for converting sound into electrical signals. One such application is the Phraselator that is currently used by Department of Defense. The Phraselator primarily consists of a microphone, an automatic speech recognition module, a language translator, and a voice synthesizer with a speaker. The English phrases spoken by the user is captured by the microphone and translated to other languages such as Dari (used in Afghanistan), and sent to a speaker, which announces the equivalent Dari phrase.

Although usable, the Phraselator is highly vulnerable to typical military noise environment resulting in degradation of its performance. The performance improves when the user holds the microphone very close to his mouth, however it still does not work all the time. The microphone, due to the presence of typical military environment noise, does not accurately capture the spoken words. Microphones pick up the acoustic signals coming from any direction from any source and cannot distinguish. Directional microphones are superior in applications if the source of the sound is always from the same direction. However, even the best directional microphones have limitations when used in military noise environment. Conventional microphones cannot differentiate between the human voice and any other environmental sound. They are unable to reproduce the spoken sounds faithfully. In addition, the reverberation of the spoken sound introduces additional complexity in conventional microphones by way of repeated sound waves. Therefore, there is an immediate need to develop a microphone or an equivalent module that is immune to the surrounding noise (military or otherwise) and has improved signal to noise ratio.

The action of speaking uses lungs, vocal chords, reverberation in the bones of the skull, and facial muscle to generate the acoustic signal that is released out of mouth and nose. The speaker hears this sound in two ways. The first one called "air conduction hearing" is initiated by the vibration of the outer ear (eardrum) that in turn transmits the signal to the middle ear (ossicles) followed by inner ear (cochlea) generating signals in the auditory nerve which is finally decoded by the brain to interpret as sound. The second way of hearing, "bone conduction hearing," occurs when the sound vibrations are transmitted directly from the jaw/skull to the inner ear thus by-passing the outer and middle ears. As a consequence of this bone conduction hearing effect, we are able to hear our own voice even when we plug our ear canals completely. That is because the action of speaking sets up vibration in the bones of the body, especially the skull.

Although the perceived quality of sound generated by the bone conduction is not on par with the sounds from air conduction, the bone conducted signals carry information that is more than adequate to reproduce spoken information.

There are several microphones available in the market that use bone conduction and are worn externally making indirect contact with bone at places like the scalp, ear canal, mastoid bone (behind ear), throat, cheek bone, and temples. They all have to account for the loss of information due to the presence of skin between the bone and the sensor. For example, Temco voiceducer mounts in ear and on scalp, where as Radioear Bone Conduction Headset mounts on the cheek and jaw bone. Similarly, throat mounted bone conduction microphones have been developed. A microphone mounting for a person's throat includes a plate with an opening that is shaped and arranged so that it holds a microphone secured in said opening with the microphone contacting a person's throat using bone conduction. Bone conduction microphones worn in ear canal pick up the vibration signals from the external ear canal. The microphones mounted on the scalp, jaw and cheek bones pick the vibration of the skull at respective places. Although the above-referred devices have been successfully marketed, there are many drawbacks. First, since the skin is present between the sensor and the bones the signal is attenuated and may be contaminated by noise signals. To overcome this limitation, many such devices require some form of pressure to be applied on the sensor to create a good contact between the bone and the sensor. This pressure results in discomfort for the wearer of the microphone. Furthermore, they can lead to ear infection (in case of ear microphone) and headache (in case of scalp and jaw bone microphones) for some users.

There are several intra-oral bone conduction microphones that have been reported. In one known case, the microphone is made of a magnetostrictive material that is held between the upper and lower jaw with the user applying a compressive force on the sensor. The teeth vibration is picked up by the sensor and converted to electrical signal. The whole sensor is part of a mouthpiece of a scuba diver.

Also, some experimental work has been done in using a tethered piezoelectric-based accelerometer mounted on teeth to measure bone conduction induced vibration and compared to standard signals. The accelerometer protruded through the lips making the approach difficult to implement in practice. The sensor is bulky and puts unbalanced load on the teeth making them useful only for experimental purposes, at the best. Therefore there still exists a need for a compact, comfortable, economical, and practical way of exploiting the tooth bone vibration to configure an intra-oral microphone and preferably wireless.

SUMMARY OF THE INVENTION

The present invention relates to a tooth microphone apparatus worn in a human mouth that includes a sound transducer element in contact with at least one tooth in mouth, the transducer producing an electrical signal in response to speech and a means for transmitting said electrical signal from the sound transducer to an external apparatus. The sound transducer can be a MEMS accelerometer, and the MEMS accelerometer can be coupled to a signal conditioning circuit for signal conditioning. The signal conditioning circuit can be further coupled to the means for transmitting said electrical signal. The means for transmitting said electrical signal can be an RF transmitter of any type, in particular a bluetooth device or a device that transmits into a Wi-Fi network or any other means of communication. The transmitter is optional.

DESCRIPTION OF THE INVENTION

The present invention, a high sensitivity tooth microphone, uses the above-referred teeth vibration as the source of sound. The high sensitivity tooth microphone can include a high sensitivity accelerometer integrated with a signal conditioning circuit, and a probe. Optionally for wireless communication, a switch can be added to the microphone. An RF transmitter, power source, and Wi-Fi, Bluetooth, or other wireless communication technology can be used to transmit out of the mouth to a nearby receiver.

A free end of the probe is held in contact with the teeth during the action of speaking. The high sensitivity tooth microphone converts the teeth vibration produced by speaking to a proportional electrical signal. This electrical signal can either be directly fed to a speaker or stored for later retrieval and use or fed to a processor for translation.

There are several features of the high sensitivity tooth microphone that makes it ideal for minimizing or even eliminating the effect of all sounds that are not generated by the wearer of the microphone. The most important are:

- Since the vibration of the skull induced by the environmental noise is negligible compared to the vibration induced due to the act of speaking, this new microphone module will be able to accurately pick up the spoken information even in a noisy environment (noise can be as high as 160 dB) with very high signal to noise ratio,
- Since external reverberated sound waves do not affect teeth, the high sensitivity microphone almost completely eliminates their (reverberation) effect on the quality of audio signal,
- The high sensitivity microphone reproduces the spoken information faithfully with the highest signal to noise ratio even when the speaker is wearing medical, gas or other type of masks.
- As the tooth microphone uses the high sensitivity technology and converts sound into electrical signal directly, it is compact, simple in design and waterproof,
- Immune to environmental conditions and hence reliable and robust, and
- Many configurations that provide a convenient and comfortable package for wearing in the mouth.

The high sensitivity tooth microphone can use a microelectromechanical systems (MEMS) accelerometer or any other accelerometer that can be mounted in the human mouth. This is generally a single axis vibration sensor along with a signal amplifier on a single chip. It can have typical parameters such as a 225-μg/$\sqrt{}$Hz-noise floor, 10-kHz bandwidth. It can also be equipped with an on-board temperature sensor, which can be used for calibrating against temperature effects.

Figure 1:
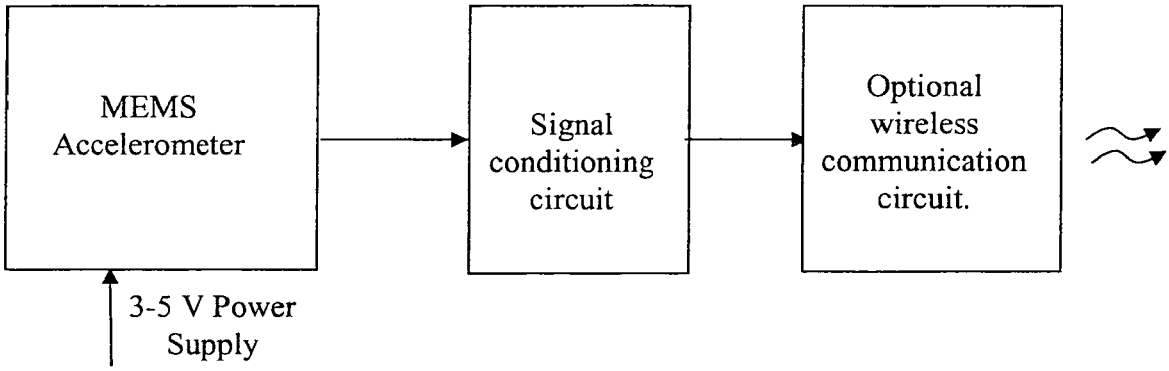
FIG. 1 shows an embodiment of the present invention.

The basic configuration of the high sensitivity tooth microphone is as shown in FIG. 1. The overall size of the accelerometer with the signal conditioning circuit in this embodiment is about 10×10×6.5 $mm^3$ with a multilayer circuit. The optional wireless communication circuit can also be about the same size. Since the amplitude of the teeth vibration is typically very small (as small as 0.1 μm), the sensitivity of a tooth microphone must be high enough to detect such small vibration. The sensitivity can be chosen by the resistors in a signal conditioning circuit. The overall design of the high sensitivity tooth microphone is generally chosen with the objective of attaining diverse goals such as small size, fabrication feasibility, durability, biological compatibility, and high precision.

Figure 2:
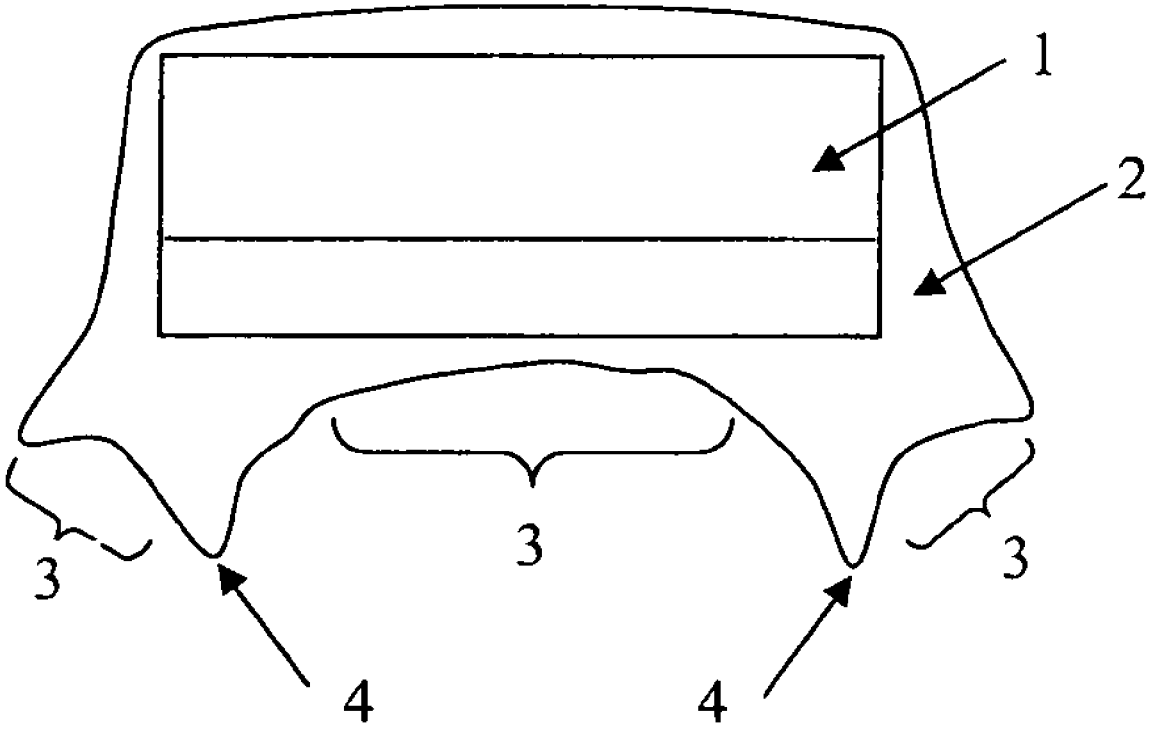
FIG. 2 shows a cross-sectional view of FIG. 1.

Packaging the high sensitivity tooth microphone is also an important aspect of the present invention. The technology of using teeth vibration for microphone use is generally the same irrespective of which specific tooth is used for coupling the probe. Although there are usually some minor variations between teeth, the overall signal is still sufficient to capture all the characteristics of the spoken sound no matter which tooth (or teeth) is chosen. The only difference is the final packaging of the microphone that varies by tooth placement, and whether it is maxillary or mandibular. FIG. 2 shows a preferred embodiment of the present invention. In this configuration, the high sensitivity tooth microphone is embedded in an acrylic or equivalent polymer. The contour of the embedded unit can be seen in FIG. 2. The contour is usually chosen so as to provide a good coupling between the acrylic and the teeth. The contour shaping normally requires a model of the teeth of the final user of the microphone. Therefore, the acrylic acts as the probe of the tooth microphone. In this case three molar teeth are in contact with the embedded tooth microphone thus providing a good coupling for bone conduction. This principle can be used in many variations by simply selecting different teeth for coupling purposes. For example, as alternative configuration, the embedded tooth microphone can be coupled to one tooth only or can be coupled with multiple teeth in all possible permutations and combinations. Finally either upper jaw or lower jaw teeth can be used to get similar results.

Similarly, in the preferred method, the outside of the right side molar teeth of upper jaw can be used for coupling purposes. One can easily reconfigure this device to couple with other (either upper jaw or lower jaw) surface of the teeth in all possible combinations. The choices of specific teeth depend on the user preference and wear comfort level. FIG. 2 shows the following: a high sensitivity tooth microphone 1, an acrylic resin build 2, a contour of the microphone and teeth interface 3, and deep coupling points into embrasures between teeth 4.

Figure 3:
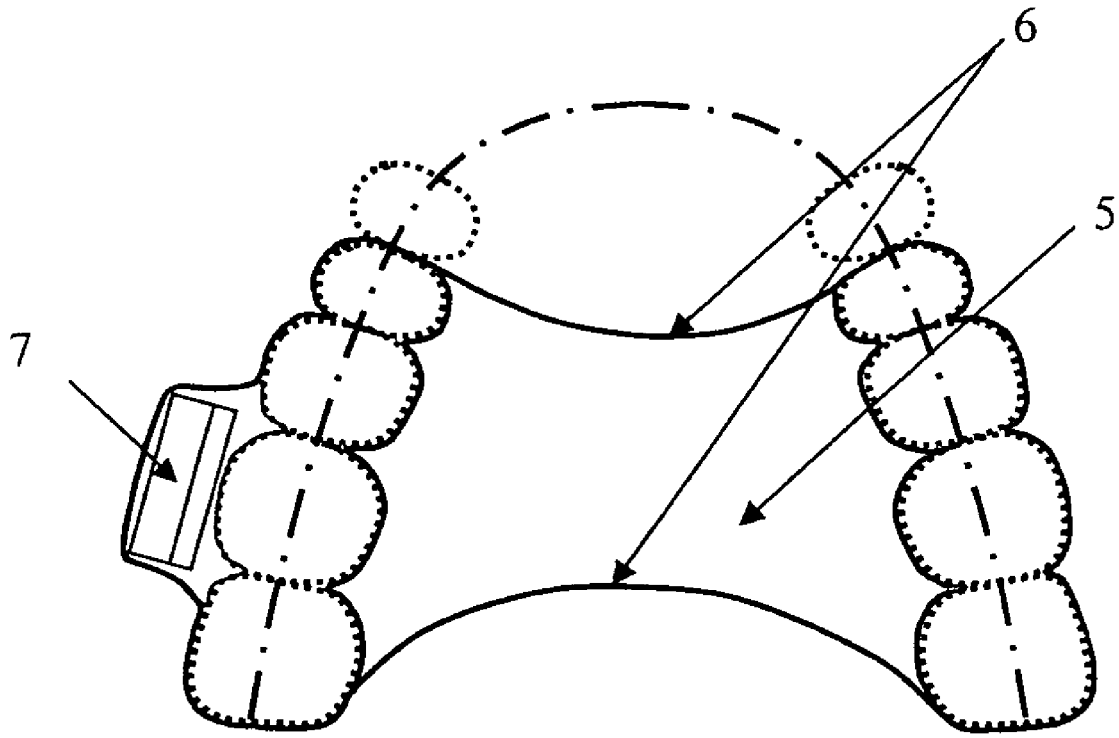
FIG. 3 shows a schematic diagram of a retainer with a microphone.

Once the high sensitivity tooth microphone is embedded in acrylic, it can be placed at the desired teeth location and encased in a polypropylene-based thermoplastic or equivalent material that has good wear resistance and durability. Although this process of fabricating the retainer can be achieved in several ways, vacuum forming is most economical. FIG. 3 shows a schematic diagram of the retainer obtained as a result of this process for the preferred embodiment. In FIG. 3, the embedded microphone is encased in the retainer that hugs multiple teeth on both sides of the upper jaw. The shape of the retainer is so chosen that it is big enough so choking, inhalation, or swallowing is impossible. Also, the retainer is undercut in the palate region to eliminate any impediment for free tongue movement in the speech critical areas. Following this principle, the shape of the retainer can easily be modified to suit specific user or application. FIG. 3 shows the following: a polypropylene retainer 5, cut outs in the retainer 6, and an embedded microphone 7.

Experiments have shown that the high sensitivity tooth microphone reproduces the entire spectrum of speech. Tests with "speech alphabets" that cover the full range of teeth vibration frequency, viz., vowels, diphthongs, plosives, nasals, fricatives, and approximants show excellent reproducibility. From these results, it is clear that the high sensitivity tooth microphone using bone conduction vibration, is a viable alternate to the conventional microphone.

Furthermore, the high sensitivity tooth microphone has been tested in noisy environments that proved that the new high sensitivity microphone is able to filter all sounds except the sounds produced by the wearer of the high sensitivity tooth microphone. For simplicity, the noise frequency range may be limited to 10 KHz. Most of the spoken voice can be captured from 200 to 8 KHz. So, with a 10 KHz it is assured that all the spoken sound signals can be captured. Simultaneously, the spoken language under noisy environment can be captured by conventional microphone for evaluation purposes. It was found out that the high sensitivity tooth microphone produces very high signal to noise ratio sound than conventional microphone since bone conduction is immune to the noise environment.

This unique features of the present invention make it ideal for applications that require communication in a noisy environment. This new microphone apparatus and method has many applications such as the Phraselators used by the Department of Defense, communication in professional sports, communication in airport tarmacs, naval aircraft carriers, language translators, audio components, communication in aircrafts, communication in underwater, communication with masks on, wearable computers, and special medical applications, to name a few.

Figure 4:
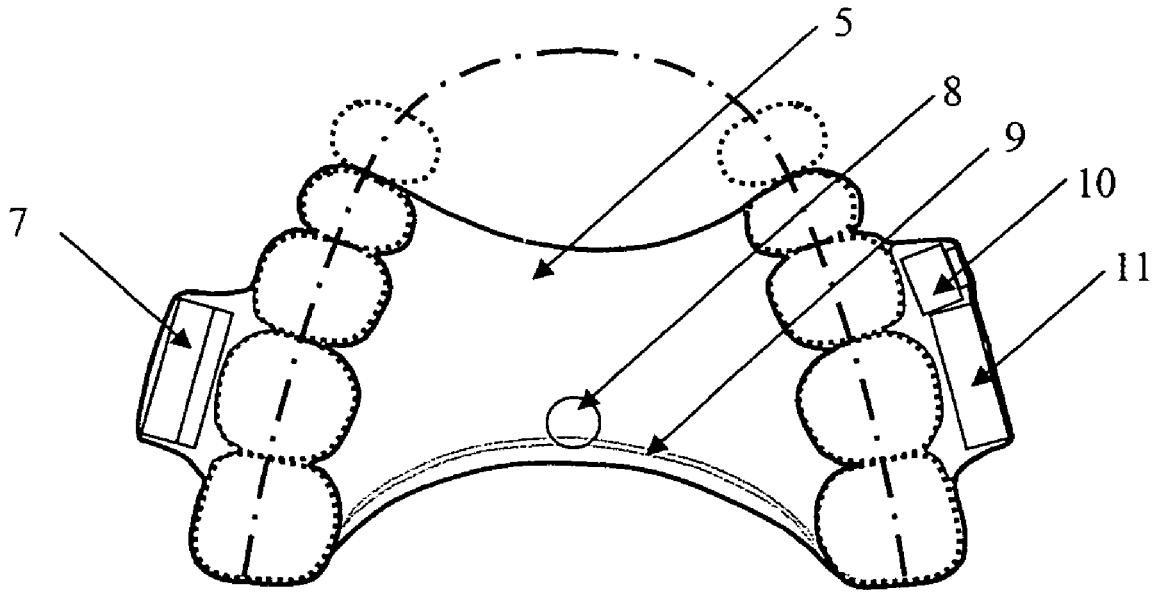
FIG. 4 shows an embodiment with wireless capability.

By adding a wireless communication unit, the high sensitivity tooth microphone has no physical wires exiting the mouth making the use most comfortable. FIG. 4 shows an embodiment of a high sensitivity tooth microphone with wireless communication option. In this configuration, the wireless communication circuit and the battery are embedded in acrylic and located at the outside surface of the teeth on the left side of the upper jaw. The battery is embedded such that it is accessible once the retainer is removed. The wire connection between the embedded tooth microphone and the wireless circuit is embedded into the polypropylene retainer as shown in FIG. 4. The position of embedded tooth microphone, wireless communication circuit and the battery can also be placed at different locations that are not shown here. Also, in this configuration, a tongue operated membrane switch can be placed preferably at the center of the palatal region as shown in FIG. 4. Alternatively, a voice activated switch could be included. FIG. 4 shows the following: High sensitivity tooth microphone 7, a retainer 5 Tongue operated switch 8, embedded connector between the microphone and a wireless communication circuit 9, Battery 10, Wireless communication circuit 11.

Figure 5:
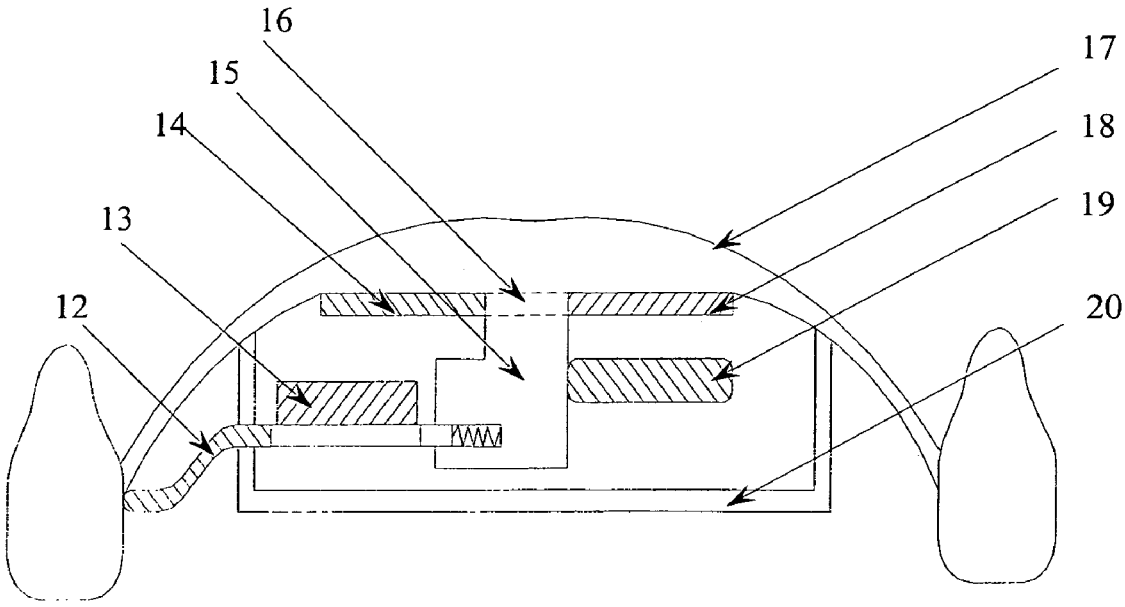
FIG. 5 shows an embodiment with a mounting strap.

FIG. 5 shows a second embodiment of the high sensitivity tooth microphone that is mounted on the metal palatal strap. The palatal strap is coupled to maxillary molar teeth with a wireless communication capability. The palatal strap, similar to the retainer, is normally custom made for each person. The configuration shows the coupling between the accelerometer and the teeth. A stainless steel (or other suitable material) probe is held against the teeth by a compression spring as shown. The accelerometer is rigidly mounted to the probe. The casing will hide all the parts inside its space except for the tip of the probe. The casing can easily be shaped to suit the application. The entire unit is made waterproof and biologically compatible. FIG. 5 shows the following: Teeth microphone probe 12, MEMS accelerometer 13, Signal conditioning circuit 14, support 15, ribbon cable 16, palatal strap 17, RF transmitter 18, battery 19, casing 20.

Figure 6:
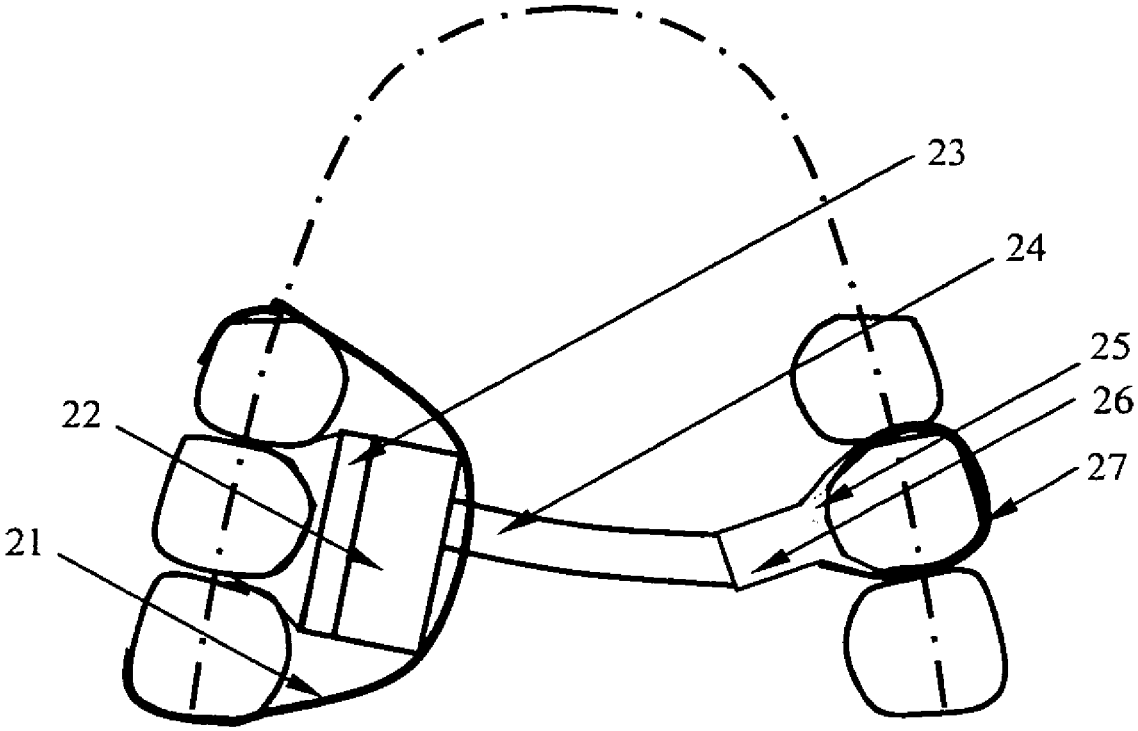
FIG. 6 shows another embodiment of the present invention.

Another embodiment of the present invention is as shown in FIG. 6. The high sensitivity tooth microphone with its probe is encased in a polymer such as acrylic. Good coupling is achieved between high sensitivity tooth microphone probe and the teeth through the transducer end fitting. The second component, transmitter, takes the voltage developed on the high sensitivity module, transmits the signal using standard RF transmitter. The wireless RF communication shown can be replaced by any other equivalent wireless technologies. FIG. 6 shows the following: a high sensitivity microphone 26, a transducer end fitting 25, a holding brace 27, a flexible ribbon 24, an RF transmitter 22, a battery 23, and a casing 21.

Many other embodiments are possible using this novel technology. They include, teeth cap with the integrated high sensitivity tooth microphone; the device attached to implants or denture, manually holding the embedded high sensitivity tooth microphone against teeth etc. When used as teeth cap or manually holding against teeth, there is no need to custom fit the user.

It will be noted that several descriptions and figures have been used to explain the present invention. The present invention is not limited by these. One of skill in the art will recognize that many changes and variations are possible. Such changes and variations are within the scope of the present invention.

We claim:

1. A tooth microphone apparatus worn in a speaker's mouth comprising:

A vibration sensing element directly in contact with at least on tooth in said speaker's mouth, wherein said vibration sensing element is responsive to vibration from said tooth caused by speech, said vibration sensing element capable of producing an electrical signal corresponding to said vibration in response to said speech in a high ambient noise environment;

a wireless transmitter transmitting said electrical signal to an apparatus external to said speaker's mouth.

2. The tooth apparatus of claim 1 wherein said vibration sensing element is a MEMS accelerometer.

3. The tooth microphone apparatus of claim 1 further comprising a signal condition circuit coupled to said vibration sensing element having a bandwidth of around 8 kHz to around 10 kHz.

4. The tooth microphone apparatus of claim 3 wherein said signal condition circuit is further coupled to said wireless transmitter.

5. The tooth microphone apparatus of claim 1 wherein said vibration sensing element has a noise floor of around 225 microgram per square root hertz or less.

6. The tooth microphone apparatus of claim 1 wherein said vibration sensing element includes a temperature sensor.

7. The tooth microphone apparatus of claim 1 wherein said vibration sensing element can detect a tooth vibration of amplitude around 0.1 micrometer or less.

8. A method for picking up and transmitting a speaker's spoken comprising the steps of:

placing a microphone element in said speaker's mouth, said microphone element directly in contact with at least one tooth, said microphone element responding to vibrations of said tooth caused by speech, said microphone element capable of producing an electrical signal representative of said spoken sound in a high ambient noise environment;

coupling a shortwave RF transmitter to said microphone element so that said electrical signal is transmitted to a remote location.

9. The method of claim 8 wherein said microphone element is a MEMS accelerometer.

10. The method of claim 8 wherein said microphone element has a noise floor of around 225 micro-gram per square root hertz or less.

11. The method of claim 8 wherein said microphone element has a bandwidth of from around 8 kHz to around 10 kHz.

12. A microphone apparatus for capturing speech comprising a MEMS accelerometer directly in contact with at least one tooth in a speaker's mouth, wherein said MEMS accelerometer responds to vibration of said tooth caused by speech, said MEMS accelerometer capable of producing an electrical signal representative of speech in a high ambient noise environment, said MEMS accelerometer being coupled to a signal conditioning circuit, said signal conditioning circuit being further coupled to a radio transmitter.

13. The microphone apparatus of claim 12 wherein said radio transmitter is a Wi-Fi transmitter.

14. The microphone apparatus of claim 13 wherein said radio transmitter is a bluetooth device.

15. The microphone apparatus of claim 12 further comprising a battery also mounted in said speaker's mouth.

16. The microphone apparatus of claim 12 further comprising a tongue-controlled switch.

17. The microphone apparatus of claim 1 wherein said wireless transmitter is a radio transmitter.

18. The microphone apparatus of claim 12 wherein said signal conditioning circuit has a bandwidth of between around 8 kHz to around 10 kHz.

19. The microphone apparatus of claim 12 wherein said MEMS accelerometer is responsive to a tooth vibration of around 0.1 micro-meter.

20. The microphone apparatus of claim 12 wherein said MEMS accelerometer has a noise floor of around 225 micro-gram per square root hertz or less.

* * * * *